US006152111A

United States Patent [19]

Potz et al.

[11] Patent Number: 6,152,111

[45] Date of Patent: Nov. 28, 2000

[54] FUEL INJECTION VALVE FOR INTERNAL COMBUSTION ENGINES

[75] Inventors: Detlev Potz, Stuttgart; Guenter Lewentz, Regensburg; Uwe Gordon, Markgroeningen, all of Germany

[73] Assignee: Robert Bosch GmbH, Stuttgart, Germany

[21] Appl. No.: 08/854,216

[22] Filed: May 9, 1997

[30] Foreign Application Priority Data

May 9, 1996 [DE] Germany ..... 96 18 698

[51] Int. Cl.[7] ..... F02M 41/00

[52] U.S. Cl. ..... 123/467; 123/447; 123/496

[58] Field of Search ..... 123/467, 447, 123/496, 472, 456

[56] References Cited

U.S. PATENT DOCUMENTS

| | | | |
|---|---|---|---|
| 3,753,426 | 8/1973 | Lilley | 123/447 |
| 4,437,443 | 3/1984 | Hofbauer | 123/467 |
| 4,662,338 | 5/1987 | Itoh | 123/467 |
| 4,779,596 | 10/1988 | Babitzka | 123/496 |
| 5,012,786 | 5/1991 | Voss | 123/447 |
| 5,156,132 | 10/1992 | Iwanaga | 123/467 |
| 5,241,935 | 9/1993 | Beck | 123/467 |
| 5,682,858 | 11/1997 | Chen | 123/467 |

*Primary Examiner*—Carl S. Miller

*Attorney, Agent, or Firm*—Ronald E. Greigg; Edwin E. Greigg

[57] ABSTRACT

The invention proposes a fuel injection valve for internal combustion engines, having a valve member (11), which can be displaced axially outward in a bore (9) of a valve body (1) counter to the force of a closing spring (47) and which on its end toward the combustion chamber has a closing head (13), protruding from the bore (9) and forming a valve closing member, that on its side toward the valve body (1) has a valve sealing face (15) with which it cooperates with a valve seat face (17) disposed on the end of the valve body (1) toward the combustion chamber, and having at least one injection opening on the closing head (13) which originates at a pressure chamber (19) and whose outlet opening is covered by the valve body (1) in the closing position of the valve member (11) and is uncovered in the outward-oriented opening stroke. In the fuel injection valve a damping chamber (35) is provided, which damps the stroke motion of the valve member (11) in the opening direction and moreover enables shaping of the course of injection.

16 Claims, 4 Drawing Sheets

FUEL INJECTION VALVE FOR INTERNAL COMBUSTION ENGINES

BACKGROUND OF THE INVENTION

The invention is based on a fuel injection valve for internal combustion engines. One such fuel injection valve, known from German Offenlegungsschrift 43 40 883 A1, U.S. Pat. No. 5,497,947, has a valve body with an axial bore in which a pistonlike valve member is guided that is displaceable outward counter to the force of a closing spring to control an injection cross section by means of the fuel pressure. On its end toward the combustion chamber, the valve member has a closing head, which protrudes from the bore of the valve body and forms a valve closing member, and on whose side toward the valve body there is a valve sealing face, with which the closing head cooperates with a valve seat face disposed on the face end of the valve body toward the combustion chamber. At least one injection opening is also provided on the valve member, at the level of the closing head, which port originates at a pressure chamber formed between the valve member and the bore. The outlet opening of the injection opening is covered by the valve body in the closing position of the valve member and is not uncovered until the valve member emerges from the bore in the course of the outward-oriented opening stroke of the valve member.

With its end remote from the combustion chamber and remote from the closing head, the valve member protrudes into a spring chamber, which is formed in a retaining body braced axially against the valve body. On its shaft end remote from the combustion chamber, the valve member has a spring plate fastened to a closing spring between a stop solidly joined to the housing and contacting the valve body.

Fuel injection is effected with the onset of high-pressure fuel feeding into the combustion chamber of the injection valve; the high fuel pressure urges the valve member in the opening direction and lifts it away from the valve seat counter to the restoring force of the closing spring. Even after a short opening stroke motion of the valve member, the injection opening is opened, so that the fuel is injected into the combustion chamber of the engine to be supplied.

The opening stroke motion of the valve member is defined by the contact of a shoulder on the valve member shaft with a stop solidly joined to the housing; the maximum opening stroke can be adjusted via the location of this stop.

The known fuel injection valve has the disadvantage, however, that the opening stroke motion of the valve member is effected quite quickly because of the high fuel pressures, and so the valve member mechanically strikes the stop quite hard, engendering major mass forces at the valve member which under some circumstances can cause the valve member to break.

Moreover, in the known fuel injection valve, the course of the opening stroke of the valve member cannot be controlled, and hence shaping the course of injection of the injection valve, by way of which the injection and consequently the combustion in the combustion chamber can be varied, is not possible.

OBJECT AND SUMMARY OF THE INVENTION

The fuel injection valve for internal combustion engines has the advantage over the prior art that the opening stroke motion of the valve member occurs in delayed fashion, so that the opening cross section at the injection valve is uncovered slowly. The delayed or damped opening stroke motion of the valve member is effected through a damping chamber acting upon the valve member, preferably a hydraulic damping chamber filled with fuel at low pressure that averts a hard impact of the valve member on the stop. The damping chamber is defined by a damping piston guided on the valve member; this piston is solidly connected to the valve member in the direction of the opening stroke motion and executes this motion along with the valve member and in so doing transmits the damping force directly onto the valve member. In the direction of the closing stroke motion, the valve member is freely movable relative to the damping position, so that rapid closure of the valve member is assured. The damping piston to that end rests with its face end remote from the damping chamber on a shoulder on the valve member shaft, which is preferably formed by a snap ring or annular shoulder formed on the valve member shaft. On its axial end remote from the damping piston, the damping chamber divided in the retaining body is defined in a structurally simple way by the end face remote from the combustion chamber of the valve body itself, or by a sleeve supported thereon.

For a purposeful damping motion of the valve member, the damping chamber can be relieved via throttle openings into a fuel-filled low-pressure chamber, preferably into the oil leakage loop; via the throttle cross section, a certain course of the opening stroke of the valve member can already be established. Hydraulically stopping the opening stroke motion of the valve member can advantageously be attained if the throttle opening is closable entirely beyond a certain stroke position of the valve member. This can be attained by means of throttle openings that can be opened by the damping piston during its reciprocation, i.e. stroke motion; a plurality of throttle openings one after another in the axial direction toward the damping piston may also be provided, which are overtaken successively by the damping piston and thus opened. Alternatively, it is possible for the cross section of the openable throttle opening to be designed such that it decreases in the opening stroke direction of the valve member.

A completely free shaping of the injection course becomes possible if the throttle cross section, or the throttled relief of the damping chamber, is adjustable continuously by means of a control valve in the relief line. This relief line can also be made to communicate with a high-pressure line, so that the restoration of the damping piston can be effected with the aid of the high fuel pressure, which makes an otherwise required restoring spring unnecessary. Another advantage of this directly controllable charging and relieving of the damping chamber is the further restoring force on the valve member, which reinforces a secure contact with the valve seat in the closing position.

The damping piston may be guided directly on the valve member shaft, but alternatively, it is also possible to guide it with its outer circumference on a bushing in which the throttle openings are provided.

The described damping arrangement for an outward-opening fuel injection valve is especially suitable for use with so-called "vario-register nozzles", in which many rows of injection openings are arranged one after another axially of the valve member and are opened in succession during the valve member stroke. The instant of opening of the individual injection port rows can be readily adjusted by means of a purposeful delay in the valve member stroke motion, so that shaping of the injection course at the injection valve can be done in a simple way. To execute this purposeful opening stroke motion of the valve member, it is especially advantageous for the injection valve to be connected to a high-pressure fuel reservoir (common rail), to various injection valves, since then during the entire injection event, a constant high-pressure level is available.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
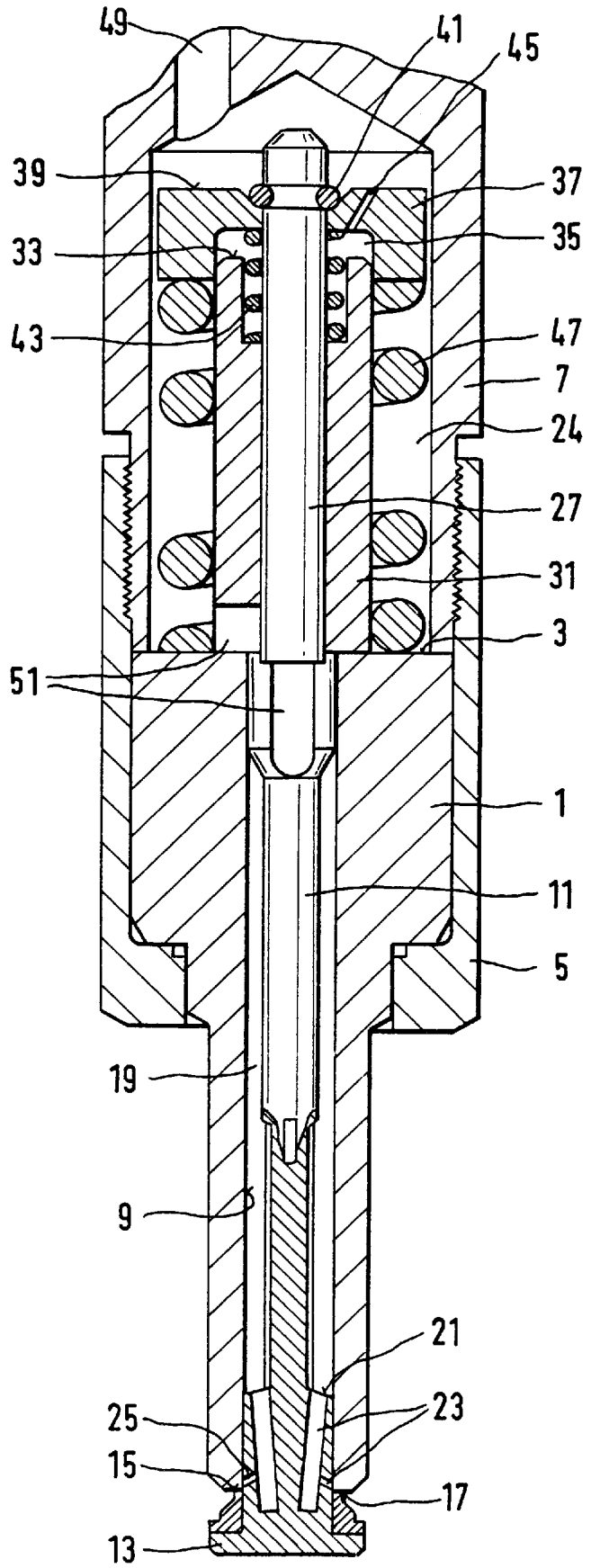
FIG. 1 shows a first exemplary embodiment in a section through the injection valve, in which the damping piston is formed by the spring plate of the closing spring.

The first exemplary embodiment of the fuel injection valve according to the invention, shown in longitudinal section in FIG. 1, has a valve body 1, which protrudes with its lower free end into the combustion chamber of the engine to be supplied and is braced axially, with its upper end face 3 remote from the combustion chamber, by means of a lock nut 5 against a valve retaining body 7. The valve body 1 has an axial through bore 9, in which a pistonlike valve member 11 is guided axially displaceably. The valve member 11, on its lower end toward the combustion chamber, has a closing head 13, protruding from the bore 9 and forming a valve closing member, which on its side toward the valve body 1 has a valve sealing face 15 with which it cooperates with a valve seat face 17 disposed on the face end toward the combustion chamber of the valve body 1. The valve sealing face 15 and valve seat face 17, which provide a sealing cross section, are preferably embodied conically, and the cone angles of the two contact faces 15, 17 deviate slightly from one another, thereby creating a defined sealing edge. Between the valve member 11 and the wall of the bore 9, an annular pressure chamber 19 is formed, which is defined toward the combustion chamber by a diameter widening of the valve member 11 that forms an annular shoulder 21 with a transition to the closing head 13. Injection openings 23 lead away from the annular shoulder 21 and are initially embodied as longitudinal bores, from which transverse bores then lead away at the level of the closing head 13. The outlet openings 25 of the injection openings 23 on the wall of the valve member 11 are disposed such that in the closing position of the valve member 11 they are covered by the bore wall 9 of the valve body 1 and are not opened until the valve member 11 emerges from the bore 9 in its outward-oriented opening stroke.

The valve member 11, with its shaft 27, protrudes into a spring chamber 29 provided in the retaining body 7; a stroke stop sleeve 31 is disposed in this chamber, guided to slide on the valve member shaft 27. The stroke stop sleeve 31 rests with its lower end face on the end face 3, remote from the combustion chamber, of the valve body 1 and with its upper end face 33 defines a damping chamber 35 that is defined on the other side by a spring plate 37 also guided on the valve member shaft 27. The spring plate 37 is embodied such that the central guide bore, with which it slides on the valve member shaft 27, widens in diameter toward the stroke stop sleeve 31 in such a way that the spring plate 37 is guided slidably displaceably on the outer circumference of the stroke stop sleeve 31. With its end face 39 remote from the damping chamber 35, the spring plate 37 rests on a snap ring 41, which is inserted into an annular groove on the end of the valve member 11 remote from the combustion chamber and forms a stop for the spring plate 37. The spring plate 37 is pressed against the valve member stop (snap ring) 41 by a restoring spring 43 that is fastened in the damping chamber 35 between the spring plate 37 and the stroke stop sleeve 31. To reduce the structure space required by the damping chamber 35, an indentation may be provided in the upper end face 33 of the stroke stop sleeve 31, with the restoring spring 43 protruding into it. To relieve the pressure of the damping chamber 35, a throttle bore 45 is also provided in the spring plate 37, discharging into the spring chamber 29. To assure a tight contact of the valve member 11 with the valve seat 17 when the injection valve is closed, and for a restoring motion of the valve member 11, a closing spring 47 is fastened in the spring chamber 29 between the spring plate 37 and the end face 3, remote from the combustion chamber, of the valve body 1.

The delivery of fuel to the pressure chamber 19 of the injection valve is effected via a pressure line 49, which originates at a high-pressure source and discharges, penetrating the retaining body 7, into the spring chamber 29. The spring chamber 29 communicates hydraulically with the pressure chamber 19 via recesses 51 on the lower end of the stroke stop sleeve 31 and on the valve member 11.

The first exemplary embodiment shown in FIG. 1 of the fuel injection valve according to the invention functions as follows:

In the closing position of the injection valve, the closing spring 47 keeps the valve member 11 with its valve sealing face 15 in contact with the valve seat 17; the damping chamber 35 is displaced into its maximum length by the restoring spring 43. With the onset of injection, fuel that is at high pressure passes via the pressure line 49 into the spring chamber 29 and on into the pressure chamber 19, where it urges the valve member 11, via the annular shoulder 21, in the opening direction. Once a certain injection pressure is attained in the pressure chamber 19, the compressive force of the fuel engaging the vm 11 exceeds the restoring force of the closing spring 47, and the valve member 11 lifts outward away from the valve seat 17. Even after a short idle stroke of the valve member 11 in the opening direction, the outlet openings 25 of the injection openings 23 are uncovered, so that the fuel passes unthrottled for injection into the combustion chamber. The maximum opening stroke motion of the valve member 11 is defined by the contact of the lower end face of the spring plate 37, which defines the damping chamber 35, with the end face 33 of the stroke stop sleeve 31; a plurality of rows of injection ports axially one after another may be provided on the valve member 11, which can be opened in succession in the course of the opening stroke of the valve member 11.

The damping of the opening stroke motion of the valve member 11 is effected by the throttled outflow of the fuel located in the damping chamber 35; the damping rate can be varied via the diameter of the throttle bore 45.

The end of injection is initiated by the termination of high-pressure fuel delivery, as a consequence of which the pressure in the pressure chamber 19 drops back below the injection pressure, and the closing spring 47 puts the valve member 11 back into contact with the valve seat 17.

Because the spring plate 37 contacts the valve member shaft 27 on only one side, it is assured that the closing stroke motion of the valve member 11 is effected quickly and is not delayed by any possible negative pressure in the damping chamber 35. The time elapsing between two injections suffices fore refilling the damping chamber 35, reinforced by the restoring spring 43, with fuel from the spring chamber 29.

In this arrangement it is especially advantageous that an oil leakage loop can be dispensed with entirely.

Figure 2:
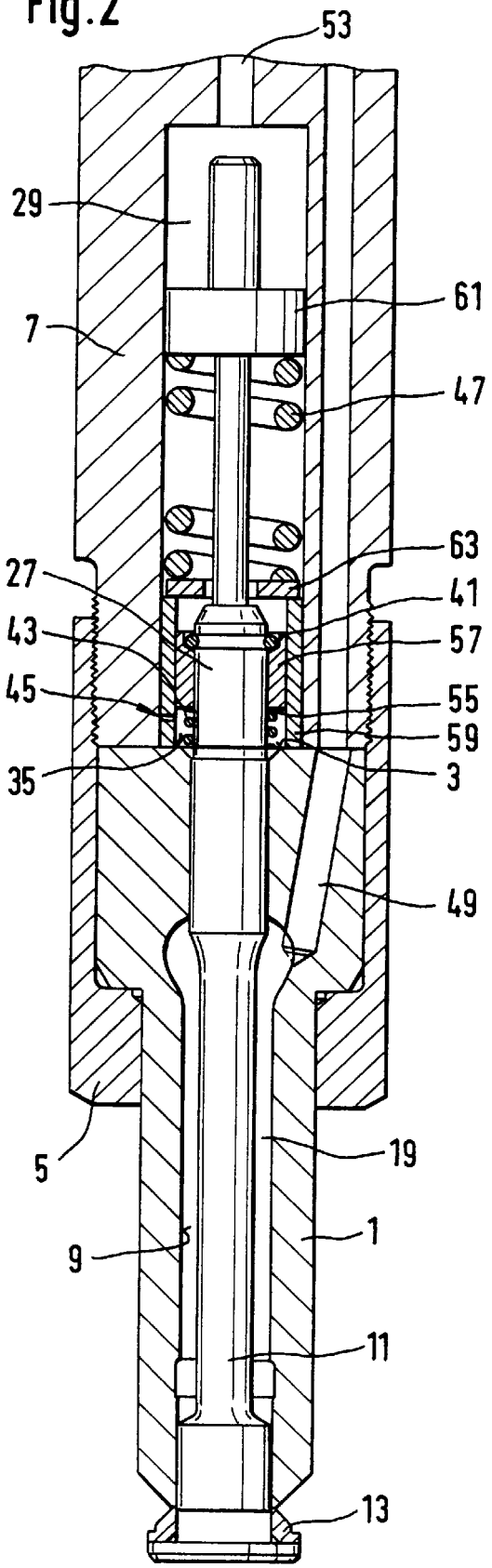
FIG. 2 shows a second exemplary embodiment in a section through the injection valve, in which the damping piston is disposed in a bushing that has the throttle openings.

The second exemplary embodiment, shown in FIG. 2, of the fuel injection valve according to the invention differs from the first exemplary embodiment in the design of the damping chamber 35 and its pressure relief, while the other components of the injection valve are designed essentially identically to FIG. 1 and have the same reference numerals.

The pressure line 49 in the second exemplary embodiment discharges directly into the pressure chamber 19, and the spring chamber 29 in the retaining body 7 communicates via a return line 53 with a relief volume (oil leakage system).

The damping chamber 35 is formed in FIG. 2 between the end face 3, remote from the combustion chamber, of the valve body 1 and a lower end face 55 of a sleeve 57 that forms the damping piston and that is guided axially displaceably on the valve member shaft 27. Radially outward, the damping chamber 35 is now defined instead by a bushing 59, which rests sealingly with its lower annular end face on the end face 3 of the valve body 1 and on whose inner wall the sleeve 57 slides.

The bushing 59 is kept in contact with the valve body 1 via the closing spring 47; on the other end, the closing spring 47 is braced on an annular shoulder 61 on the end remote from the combustion chamber of the valve member 27. To adjust the prestressing force of the closing spring 47, a shim 63 may be provided between the closing spring 47 and the bushing 59.

The sleeve 57 that defines the damping chamber 35 rests with its end face remote from the damping chamber 35 again on a stop of the valve member 11, this stop preferably being formed by a snap ring 41; in the exemplary embodiment, a restoring spring 43 is fastened between the sleeve 57 and the valve body 1.

The throttle opening that relieves the damping chamber 35 is provided in the wall of the bushing 59 and discharges into an annular gap provided between the bushing 59 and the housing wall that defines the spring chamber 29.

The throttle opening 45 is disposed in the bushing 59 in such a way that in the course of the stroke motion of the sleeve 57 it is overtaken by the sleeve and thus opened, so that the damping action at the valve member 11 is still further reinforced. The instant and course of this reinforced damping action can be adjusted by means of the location and embodiment of the throttle opening 49. The leakages from the damping chamber 35 at the components 57, 59 and 27 are so slight that after the throttle opening 45 is opened, a quasi-static stroke stop is formed by means of the volume enclosed in the damping chamber 35. Moreover, a certain interval after opening of the throttle opening 45, a mechanical stroke stop is provided, which limits the stroke motion of the valve member 11 in emergency operation.

Figure 3:
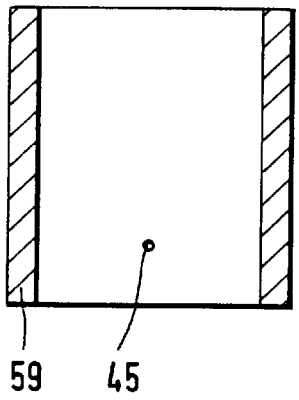
FIGS. 3–5 show various embodiments of the throttle openings in the bushing.
Figure 4:
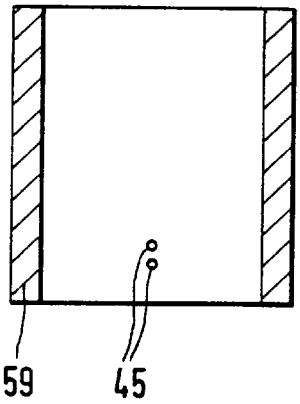
Figure 5:
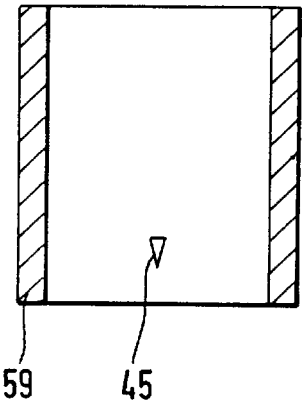

In addition to the single throttle bore 45 shown in FIG. 3, it is also possible to provide a plurality of throttle bores 45, disposed one after another in the axial direction of the valve member 11, as shown in FIG. 4; they are then capable of shaping an opening stroke course in two or more stages. The valve member damping in the last opening stroke region can also, as shown in FIG. 5, be attained by decreasing the cross section of the throttle opening 45 in the direction of the opening motion of the valve member; by the purposeful design of the timing of the throttle cross section, virtually any course of the opening stroke of the valve member can be shaped.

The second exemplary embodiment, shown in FIG. 2, of the fuel injection valve according to the invention functions in the same way as the injection valve described in conjunction with FIG. 1; the damping of the opening motion of the valve member can be shaped by purposeful opening of the throttle opening 45.

Figure 6:
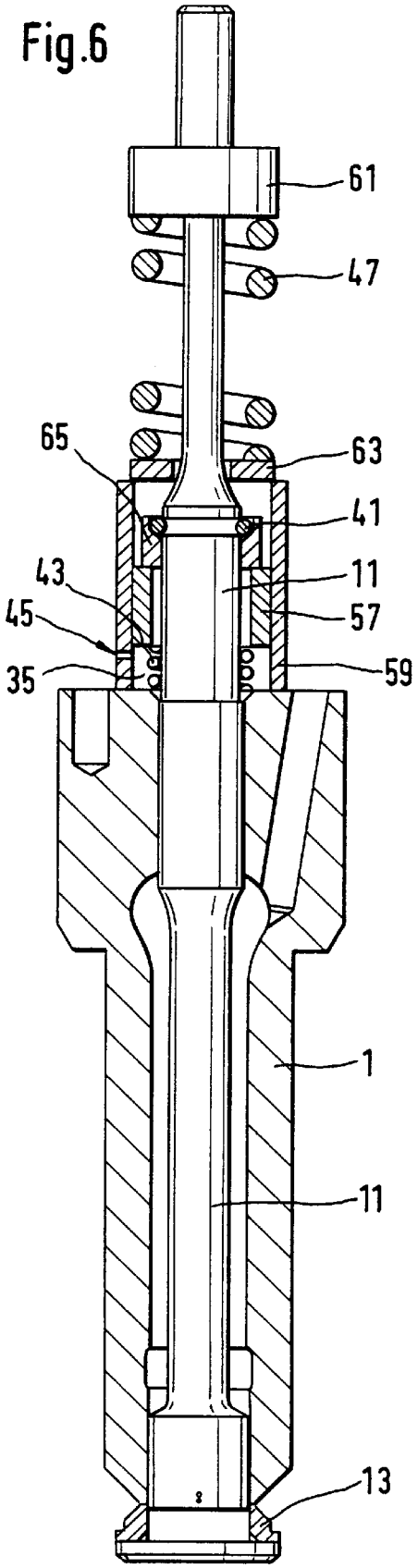
FIG. 6 shows a third exemplary embodiment in a section through the injection valve, in which the damping piston is embodied in two parts and is guided along the wall of the bushing.

The third exemplary embodiment, shown in FIG. 6, differs from the second exemplary embodiment shown in FIG. 2 only in the embodiment of the damping piston that defines the damping chamber 35; the sleeve 57 is now guided only with its outer circumference on the inner wall of the bushing 59, so that it is unnecessary to provide for internal fitting involving tolerances of the sleeve 57 to the valve member 11. The sealing off of the damping chamber 35 is now effected via a blocking sleeve 65, which is fastened between the snap ring 41 and the sleeve 57 and rests sealingly only on the valve member 11; the (optional) restoring spring 43 keeps the sleeve 57 in tight contact with the closing sleeve 65.

Figure 7:
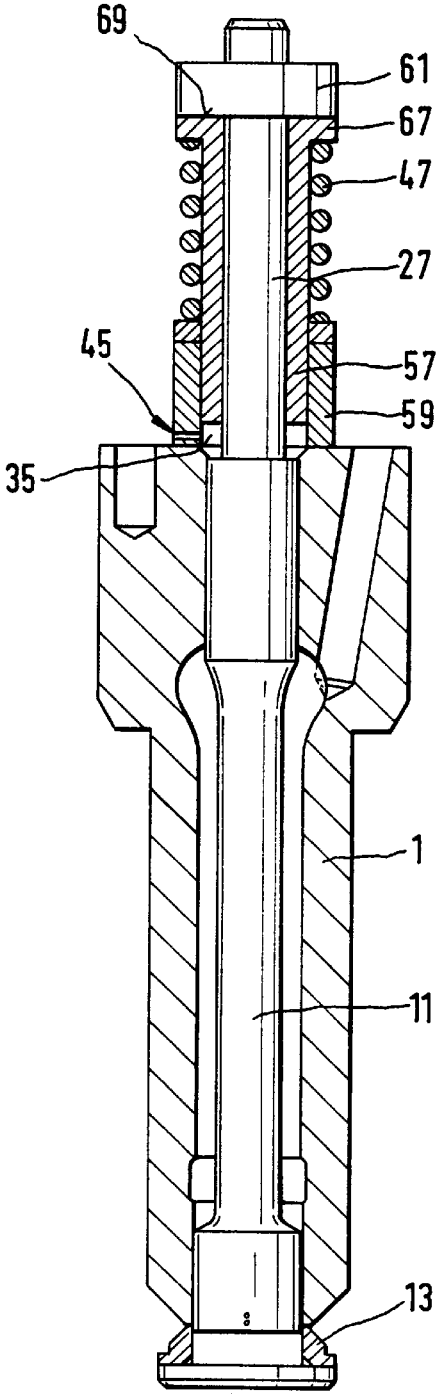
FIG. 7 shows a fourth exemplary embodiment in a section through the injection valve, in which the damping piston is supported directly on an annular shoulder of the valve member that forms a spring plate for the closing spring.

In the fourth exemplary embodiment of the fuel injection valve of the invention, shown in FIG. 7, the sleeve 57, on its end remote from the damping chamber 35, has an annular collar 67, which is engaged by the closing spring 47 and thus presses the sleeve 57 with its end face 69 remote from the damping chamber 35 against the annular shoulder 61 of the valve member shaft 27. Here the closing spring 47 additionally takes on the task of displacing the sleeve 57, acting as a damping piston, back into its outset position so that the damping chamber 35 can be refilled with leaking oil or fuel, so that an additional restoring spring in the damping chamber 35 can be dispensed with.

Figure 8:
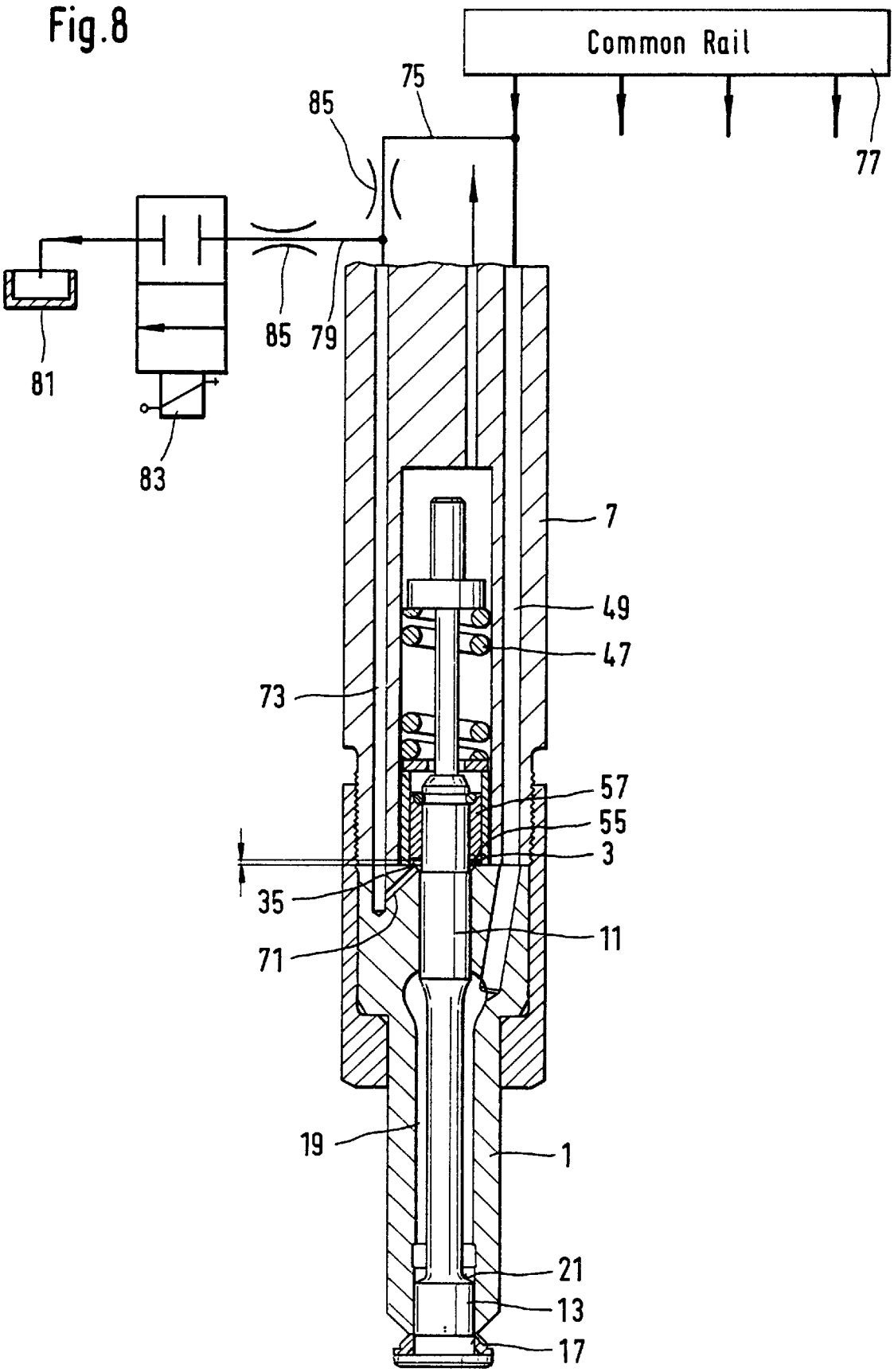
FIG. 8 shows a fifth exemplary embodiment in a section through the injection valve, in which the relief line of the damping chamber communicates with a high-pressure line and a return line, of the kind that are present for instance in a reservoir-type injection system.

The design of the fifth exemplary embodiment of the fuel injection valve according to the invention, shown in FIG. 8, is equivalent to the structural design of the second exemplary embodiment, shown in FIG. 2, except for the way in which the damping chamber 35 is pressure-relieved.

For pressure relief and filling in the fifth exemplary embodiment, a relief bore 71 is provided, which leads away from the end face 3, defining the damping chamber 35 on one side, of the valve body 1 and discharges into a relief conduit 73. The relief conduit 73, which penetrates the retaining body 7, communicates with a pressure line 75 leading to a high-pressure fuel reservoir 77 and with a return line 79 into a relief chamber 81; the return line is closable by a 2/2-way magnet valve 83. In addition, one throttle 85 each is inserted into the return line 79, between the relief conduit 73 and the 2/2-way valve 83, and into the pressure line 75, between the relief conduit 73 and the high-pressure fuel reservoir 77.

The damping device of the valve member 11 in the fifth exemplary embodiment functions as follows:

With the 2/2-way valve 83 closed, a certain hydraulic pressure is built up, via the throttle 85 in the pressure line 75, and under the sleeve 57 acting as a damping piston, in the damping chamber 35; by means of this pressure the valve member 11 is pressed firmly against the valve seat 17 in a manner that supplements the closing spring 47. With the onset of high-pressure injection (analogous to FIG. 2), the 2/2-way valve 83 opens, so that the volume in the damping chamber 35 is relieved by the relief bore 71, the relief conduit 73, and the return line 79 via the throttle 85 disposed in it. The pressure relief in the damping chamber 35 and thus the damping rate of the opening stroke course of the valve member 11 can be adjusted freely (in what is known as rate shaping) via the cross section of the throttle restriction 85 in the return line 79 and via the triggering of the 2/2-way valve 83.

The maximum opening stroke of the valve member 11 is defined by the contact of the sleeve 57 with the end face 3, remote from the combustion chamber, of the valve body 1; alternatively, an inserted mechanical ring could define the stroke.

At the end of the high-pressure injection, the 2/2-way valve 83 closes the return line 79 again, so that the high fuel pressure in the damping chamber 35 builds up again from the high-pressure reservoir 77 via the throttle 85 in the pressure line 75; this pressure, together with the closing spring 47 and the pressure in the engine combustion chamber that urges the valve member 11 in the closing direction, moves the valve member 11 back onto the valve seat 17 very quickly.

For the function of the damping device described in conjunction with FIG. 8, it is essential that the cross section of the annular face 21 of the closing head 13 of the valve member 11 be greater than the cross section of the valve member shaft that defines the pressure chamber 39 on the other side and be less than the cross section of the lower annular end face 55 of the sleeve 57 that defines the damping chamber.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, having a valve member (11), which can be displaced axially outward in a bore (9) of a valve body (1) counter to the force of a closing spring (47) and which on an end toward the combustion chamber has a closing head (13) that protrudes from the bore (9) and forms a valve closing member, that on a side toward the valve body (1) has a valve sealing face (15) which cooperates with a valve seat face (17) disposed on an end of the valve body (1) toward the combustion chamber, and at least one injection opening (23) on the closing head (13) which originates at a pressure chamber (19) and whose outlet opening (25) is covered by the valve body (1) in a closing position of the valve member (11) and is uncovered in an outward-oriented opening stroke, and in the fuel injection valve a damping chamber (35) is provided, which damps a stroke motion of the valve member (11) in the opening direction, a damping piston is disposed axially displaceably on a valve member shaft (27) of the valve member (11), which damping piston with one end face defines the damping chamber (35) and with an end face 2 remote from the damping chamber (35) rests on a shoulder of a valve member (11), and the damping chamber (35) can be relieved into a low-pressure chamber via at least one throttle opening (45).

2. A fuel injection valve in accordance with claim 1, in which the throttle opening (45) is openable.

3. A fuel injection valve in accordance with claim 1, in which the valve member shaft (27) protrudes into a spring chamber (29), which is provided in a retaining body (7) braced axially against the valve body (1), and that a stroke stop sleeve (31) is disposed on the valve member shaft (27) that protrudes into the spring chamber (29), said valve member shaft (27) rests with one end face on the end face (3), remote from the combustion chamber, of the valve body (1) and which with an end face (33) remote from the valve body (1) defines the damping chamber (35).

4. A fuel injection valve in accordance with claim 3, in which the damping chamber (35), on an end remote from the stroke stop sleeve (31), is defined by a spring plate (37), which forms a damping piston, said spring plate (37) is guided displaceably on the valve member shaft (27) by means of an axial through bore, and rests with a face end (39), remote from the damping chamber (35), on a shoulder, formed by a snap ring (41), of the valve member (11).

5. A fuel injection valve in accordance with claim 4, in which the closing spring (47) of the valve member (11) is fastened between the spring plate (37) and the end face (3), remote from the combustion chamber, of the valve body (1), and a restoring spring (43) of the damping chamber (35) is fastened between an end of the stroke stop sleeve (31) and the spring plate (37).

6. A fuel injection valve in accordance with claim 5, in which a maximum opening stroke of the valve member (11) is defined by a contact of the spring plate (37) with the stroke stop sleeve (31).

7. A fuel injection valve in accordance with claim 4, in which the throttle opening (45) of the damping chamber (35) which bore discharges into a fuel-filled spring chamber (29) is provided in the spring plate (37).

8. A fuel injection valve in accordance with claim 2, in which the valve member shaft (27) protrudes into a spring chamber (29) that is provided in a retaining body (7) braced axially against the valve body (1), and that a sleeve (57) forming the damping piston is disposed displaceably on the valve member shaft (27) that protrudes into the spring chamber (29), said sleeve, with lower end face (55) near the combustion chamber, defines the damping chamber (35) and which rests with an upper end face, remote from the combustion chamber, on a snap ring (41), on the shaft (27) of the valve member (11).

9. A fuel injection valve in accordance with claim 8, in which the damping chamber (35) is defined on its end remote from the sleeve (57) by the end face (3), remote from the combustion chamber, of the valve body (1), and the throttle bore (45) leads away from the end face (3) of the valve body (1) and discharges into a relief conduit (73).

10. A fuel injection valve in accordance with claim 9, in which the relief conduit (73) communicates with a pressure line (75) to a high-pressure fuel reservoir (77) and a return line (79) into a relief chamber (81), the return line (79) being openable by a 2/2-way valve (83), and one throttle (85) each being inserted into the pressure line (75) and the return line (79), between the relief conduit (73) and the high-pressure reservoir (77) and between the relief conduit (73) and the 2/2-way valve (83), respectively.

11. The fuel injection valve in accordance with claim 8, in which the sleeve (57) forming the damping piston is guided axially displaceably with an outer circumference in a stationary bushing (59), which with one end face rests on the end face (3), remote from the combustion chamber, of the valve body (1) and forms a radial boundary of the damping chamber (35), and at least one throttle opening (45) that discharges into a relief chamber is disposed in the bushing (59) in the region of the damping chamber (35).

12. A fuel injection valve in accordance with claim 11, in which the throttle opening (45) is openable by the sleeve (57) in the course of the opening stroke motion of the valve member (11).

13. A fuel injection valve in accordance with claim 12, in which a plurality of throttle openings (45) are located one above the other in an axial direction of the valve member (11).

14. A fuel injection valve in accordance with claim 12, in which the cross section of the throttle opening (45) decreases in a direction remote from the sleeve (57).

15. The fuel injection valve in accordance with claim 11, in which the damping chamber (35), on its end remote from the sleeve (57), is defined by the end face (3), remote from the combustion chamber, of the valve body (11), and a restoring spring (43) is fastened between the sleeve (57) and the valve body (1).

16. A fuel injection valve in accordance with claim 11, in which the sleeve (57) rests with an end face (69) remote from the damping chamber (35) on an annular shoulder (61) of the valve member (11), and that the closing spring (47) of the injection valve is fastened between an annular collar (67), disposed on the upper end of the sleeve remote from the combustion chamber, and the end face of the bushing (59) remote from the valve body (1).

* * * * *